US005303837A

United States Patent [19]

Adams et al.

[11] Patent Number: 5,303,837

[45] Date of Patent: * Apr. 19, 1994

[54] ONE-PIECE FITMENT AND PLUG WITH TAMPER-EVIDENT BAND

[75] Inventors: Brian M. Adams, Newark; Daniel Luch, Los Gatos, both of Calif.

[73] Assignee: Portola Packaging, Inc., San Jose, Calif.

[ * ] Notice: The portion of the term of this patent subsequent to Dec. 21, 2010 has been disclaimed.

[21] Appl. No.: 823,200

[22] Filed: Jan. 21, 1992

Related U.S. Application Data

[63] Continuation-in-part of Ser. No. 664,658, Mar. 5, 1991, abandoned, and a continuation-in-part of Ser. No. 780,774, Oct. 22, 1991, Pat. No. 5,174,465.

[51] Int. Cl.[5] ..... B65D 47/10; B65D 51/18; B65D 55/02

[52] U.S. Cl. ..... 220/254; 220/265; 220/270; 220/276; 220/359; 215/214; 215/232; 215/253; 215/256; 215/356; 229/125.15; 222/541; 222/562; 222/566

[58] Field of Search ..... 220/265, 254, 270, 276, 220/359; 215/214, 216, 232, 252, 253, 254, 256, 356, 32, 33; 229/125.15; 222/541, 545, 562, 566, 569

[56] References Cited

U.S. PATENT DOCUMENTS

| | | | |
|---|---|---|---|
| 2,400,716 | 5/1946 | Sattler | 229/125.15 X |
| 3,021,976 | 2/1962 | Tracy | 220/254 X |
| 3,128,900 | 4/1964 | Chaboche | 215/32 |
| 3,405,837 | 10/1968 | Carpenter, Jr. | 220/265 X |
| 3,902,621 | 9/1975 | Hidding | 215/252 |
| 3,998,354 | 12/1976 | Song | 220/269 |
| 4,019,663 | 4/1977 | Krautkramer | 215/32 X |
| 4,114,779 | 9/1978 | Stoll, III | 220/288 |
| 4,172,533 | 10/1979 | Montgomery | 215/216 |
| 4,360,113 | 11/1982 | Luker | 215/216 |
| 4,399,924 | 8/1983 | Nilsson | 220/257 |
| 4,445,620 | 5/1984 | Brochman et al. | 220/271 |
| 4,630,743 | 12/1986 | Wright | 215/216 |
| 4,669,640 | 6/1987 | Ando et al. | 220/276 X |
| 4,711,364 | 12/1987 | Letica | 220/276 |
| 4,785,963 | 11/1988 | Magley | 220/266 |
| 4,813,578 | 3/1989 | Gordon et al. | 229/125.14 X |
| 4,819,839 | 4/1989 | Carlsson et al. | 229/125.15 X |
| 4,909,434 | 3/1990 | Jones et al. | 220/359 X |
| 4,972,568 | 11/1990 | Schurr | 220/601 X |
| 5,012,941 | 5/1991 | Abrams et al. | 215/250 |

*Primary Examiner*—Allan N. Shoap
*Assistant Examiner*—Vanessa Caretto
*Attorney, Agent, or Firm*—Julian Caplan

[57] ABSTRACT

A fitment attached around an aperture in a container has a flange from which extends an internally threaded spout closed by an initially integrally molded externally threaded plug. The plug is moved axially into the spout, the threads slipping over each other. The plug has an outward extending slotted ear and the fitment has an upward extending finger aligned with the slot in the ear and formed with tangs which lock the finger and ear together as the plug is moved to the spout, thereby making the device tamper-evident. As a further feature of the invention, an over-size foil seal extends across the bottom of the flange and is welded or otherwise adhered to the bottom of the flange. After assembly the portion of the foil extending outside the flange is welded or otherwise adhered to the carton. This further feature is particularly useful in aseptic packaging. Optionally the lower edge of the plug may be welded to the foil so that when the consumer unscrews the plug the foil under the spout is torn away.

14 Claims, 5 Drawing Sheets

ONE-PIECE FITMENT AND PLUG WITH TAMPER-EVIDENT BAND

CROSS-REFERENCE TO RELATED APPLICATIONS:

This application is a continuation-in-part of U.S. applications Ser. No. 07/664,658, filed Mar. 5, 1991, entitled SPOUT FITMENT CLOSURE PLUG now abandoned and Ser. No. 07/780,774, filed Oct. 22, 1991, entitled ONE-PIECE FITMENT AND CAP WITH TAMPER-EVIDENT BAND now U.S. Pat. No. 5,174,465.

BACKGROUND OF THE INVENTION

Field of the Invention

This invention relates to a new and improved spout fitment and a plug type cap for closing same. More particularly, the invention relates to a fitment which fits around a hole in a panel of a paperboard carton or around a hole in a flexible container, or the like, such as used for packaging liquid products and powders and to a closure for such fitment. The invention is further characterized in that it is tamper-evident. Further, in a modification of the invention, it has container sealing features making it useful in aseptic packaging.

Description of Related Art

Generally speaking, prior fitments have spouts with external threads closed by caps with internal threads. Some fitments are used in conjunction with plastic bag containers, the fitment being integrally welded to the plastic bag. Other prior art fitments are attached to a polymer-coated paperboard container such as a gable-top half-gallon container which, optionally, may be lined with foil or plastic. Generally, prior art fitments for paperboard cartons include a thin flange which is welded to the surface of the container. The closure includes a foil seal which seals the mouth of the spout and a liner for the cap which serves a re-sealing function. Attachment to the polymer coated paperboard is accomplished by welding the flange of the spout to the polymer coating. Upon initial removal, the tamper-evident foil seal is removed and discarded.

Fitments of the prior art have a number of deficiencies as compared to the present invention. In the first place, they employ multiple components which increase the cost of the combination very greatly over the simple structures of the present invention. Secondly, the assembly is difficult and involves rotary equipment which is difficult to control in practice and is expensive to install. Thirdly, because of the fact that the prior art spouts are externally threaded, the diameter of the opening in the spout is restricted inasmuch as there is only limited space on the panel of the container on which the flange can be located, thereby reducing the diameter of the fitment flange and correspondingly the internal diameter of the spout. Fourthly, commercially available fitment-closure combinations have no external tamper-evident features, demonstrated, for example, by the internal foil seal of the spout opening of the prior art. Finally, prior fitment-closure combinations have not been adoptable to aseptic packaging.

The openings in prior container panels have been closed off by barrier layers such as shown in U.S. Pat. No. 4,813,578. Such barrier layers are, however, usually part of the laminate of which the container panel is formed. Portions of the plug or cap are secured to the barrier so that when the plug is removed, the barrier is fractured, providing access to the interior of the container. The use of the laminate as the barrier involves manufacturing difficulties which do not occur in accordance with the present invention.

All of the foregoing deficiencies are eliminated in the present invention.

SUMMARY OF THE INVENTION

In accordance with the present invention, a fitment having a spout into which the skirt of a plug fits are provided. Either the spout and plug skirt are formed with mating threads or the telescoping surfaces are so formed that they are liquid-tight when assembled.

In one form of the invention, a foil disk of greater diameter than the flange of the fitment is attached to the under side of the flange by welding and the foil may also be welded to the bottom edge of the plug which fits into the spout of the fitment. The assembled fitment and plug are inserted through the opening in the container panel from the inside of the container and the foil is welded to the under side of the container panel in liquid-tight fashion. This construction is useful in aseptic packaging since the sealing of the foil to the container panel around the opening in the container prevents contamination of the interior of the container after filling.

In one form of the invention, the interior of the fitment is threaded and the plug therefor is externally threaded. Around the plug is a tamper-evident band connected thereto by a frangible line of weakness. Depending from the tamper-evident band are diametrically opposed fingers and extending from the fitment flange are diametrically opposed sockets shaped to receive the plug fingers and so constructed as to restrain unscrewing of the plug so long as the tamper-evident band is intact.

In another form of the invention, a finger projects upward from the fitment spout and the plug is formed with a loop which receives the finger. The plug cannot be unscrewed without removal of the finger, thereby providing evidence of tampering.

In still another form of the invention, wherein the interior of the spout and the exterior of the plug skirt have an interference or liquid-tight fit, the finger extending up from the spout is received in an aperture in a flange of the plug. The finger is formed with tangs which lock against the upper side of the plug flange and prevent removal of the assembled plug and fitment so long as the finger remains intact.

Initially, the plug and fitment are preferably molded in a single mold and the two parts are connected together by frangible gates joining the cap skirt and the upper edge of the fitment spout. Either in the final stage of the molding process or separately, the cap is depressed relative to the fitment by a straight axial push. Where the plug and fitment are threaded, the mating threads of the cap and spout slip over each other in this operation and seat in liquid-tight fashion. At the same time the parts are collapsed, the finger of the fitment is inserted into a socket in the plug. Alternatively, where there is a frangible tamper-evident band on the plug, the depending finger of the band fits into a socket on the flange of the fitment. In assembled position, the cap cannot be removed without giving evidence of tampering. The fitment flange is then attached to the container and the container is filled.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
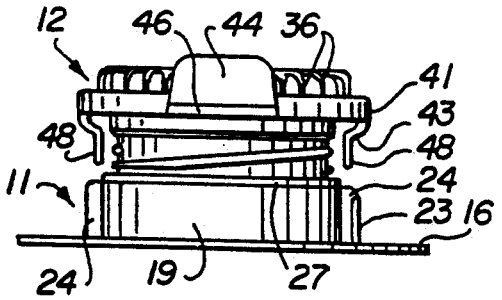
FIG. 1 is a side elevational view of the plug and fitment prior to assembly.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

In the form of the invention shown in FIGS. 1-8, there are a fitment portion 11 and a plug or cap portion 12. Fitment portion 11 has an annular flange 16 which is attached to the container panel 13 surrounding the hole 14 therein. Panel 13 may be part of a variety of containers, including paperboard cartons, plastic containers, bags and others. Various means may be used to join the flange 16 to the panel 13. Welding the flange to the panel is a preferred choice in the present invention.

Figure 2:
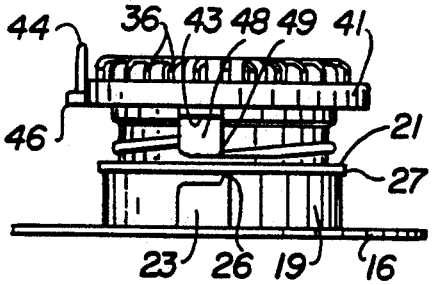
FIG. 2 is a view similar to FIG. 1 rotated 90 degrees.
Figure 3:
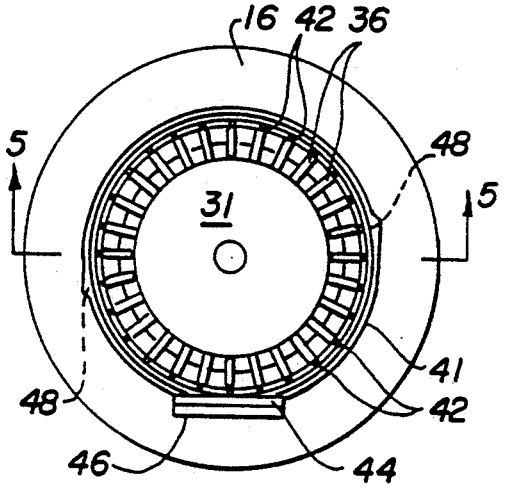
FIG. 3 is a top plan view of the structure of FIG. 1.
Figure 4:
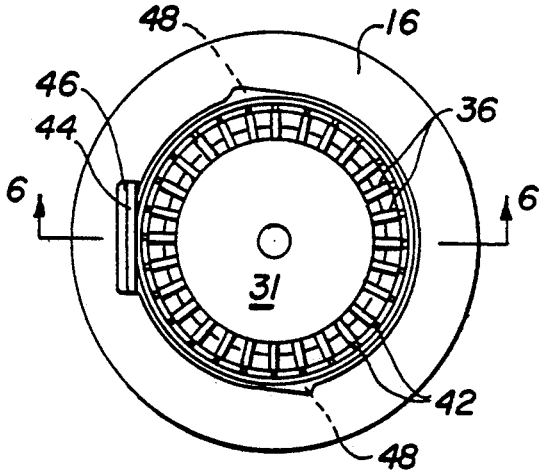
FIG. 4 is a top plan view of the structure of FIG. 2.
Figure 5:
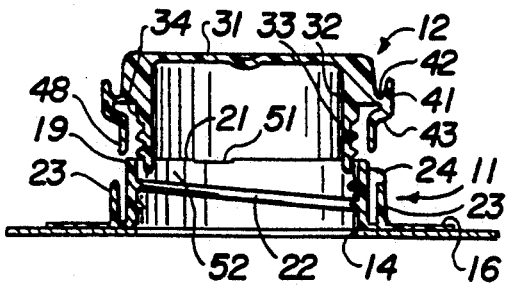
FIG. 5 is a sectional view taken substantially along the line 5—5 of FIG. 3.
Figure 6:
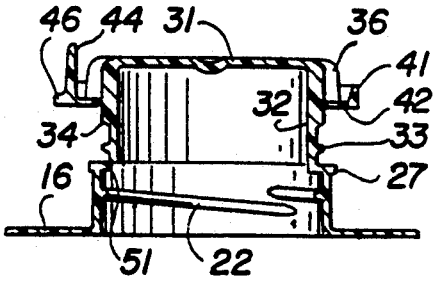
FIG. 6 is a sectional view taken substantially along the line 6—6 of FIG. 4.

Projecting upward from the inside of the flange 16 is a spout 19 having a top edge 21. Internal threads 22 are formed in the spout 19. Spaced outwardly of spout 19 and projecting upward from flange 16 is a socket wall 23 which is parallel to a tangent to the outside of the spout 19. One end of wall 23 is closed off by a radial socket wall end 24. As shown in the accompanying drawings, there are two socket walls 23 diametrically spaced apart. It will be understood that a single socket or more than two sockets may be used. Socket wall 23 has an upward projection 26 which joins the socket end wall 24, as best shown in FIG. 2. The outer wall of spout 19 is formed with an outward projecting peripheral flange 27 immediately below its top edge 21. The flange 27 is continuous except immediately above socket walls 23.

Plug 12 has a top disk 31 from which depends skirt 32, which is formed with external threads 33 to mate with the threads 22. Shoulder 34 is formed at the upper end of the threads 33. External ribs 36 curve from the periphery of top disk 31 downwardly and assist the user in gripping the cap portion 12 to unscrew it from the fitment. Surrounding skirt 32 and spaced outwardly thereof is a horizontal tamper-evident band 41. The lower edge of band 41 is connected to the skirt 32 by frangible bridges 42 which may constitute extensions of the lower edges of ribs 36. Thus the bridges 42 alternate with voids therebetween to form a line of weakness between band 41 and skirt 32. It will be understood that other means may be used to create a line of weakness between the band 41 and the skirt 32. In at least one location, there is an upward-extending pull tab 44 integral with the band 41 and projecting upward so that it may be conveniently gripped by the consumer to tear off the band 41. As a further means to facilitate tearing off the band 41, at least one outward-projecting thumb tab 46 may be provided. Thus the consumer may either grip the tab 44 and pull upward or insert a finger or thumb under the tab 46 and pull upward to remove band 41.

Extending downward from band 41 in one or more locations (here shown as two in number) are tamper-evident fingers 48 which are shaped parallel to a tangent drawn to the exterior of skirt 32. The fingers 48 are joined to the band 41 by downward-inward curved connections 43.

The plug portion 12 and fitment portion 11 are initially connected together by frangible radial lugs or gates 51 joining the edge of skirt 32 to the top edge 21 of spout 19. The lugs or gates are preferably positioned radially to coincide with the projected extension of helical thread 33, so that the gates form an effective thread runout. As illustrated, there are two diametrically spaced lugs 51, subject to variation. This is because the embodiment shown is a double lead thread.

Either during a final ejection stage of the molding process or subsequently, the plug 12 is pushed down so that the skirt 32 slips inside the spout 19. Threads 33 and 22 are so shaped and positioned that they will slip past each other in registration during this downward movement. The fingers 48 are so located with reference to the socket walls 23 that a straight downward push of the plug 12 seats the fingers 48 inside the socket walls 23 and adjacent the socket end walls 24.

End walls 24 prevent the plug 12 from being unscrewed because the fingers 48 abut thereagainst. If one attempts to unscrew the plug 12, the fingers 48 encountering the walls 24 prevent such turning. If the consumer forces turning of the plug 12, fracture of the bridges 42 occurs, thereby giving evidence of tampering.

Figure 7:
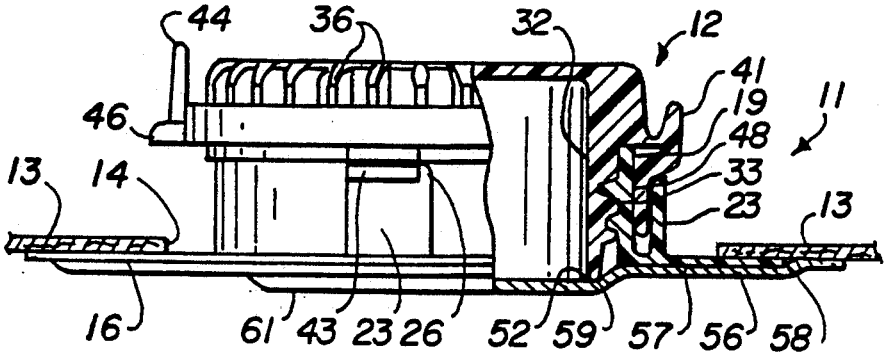
FIG. 7 is a view, partially broken away in section, showing the plug assembled in the fitment, and the fitment and an aseptic seal applied to a portion of a container panel.
Figure 8:
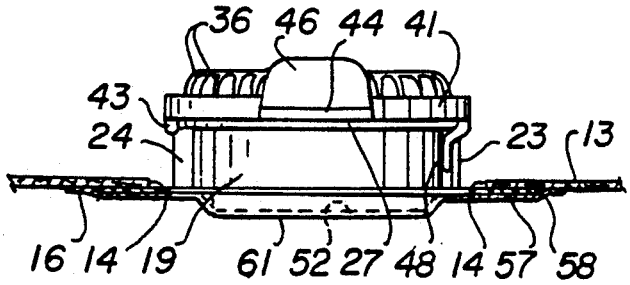
FIG. 8 is a view similar to FIG. 7 without the device being sectioned.
Figure 9:
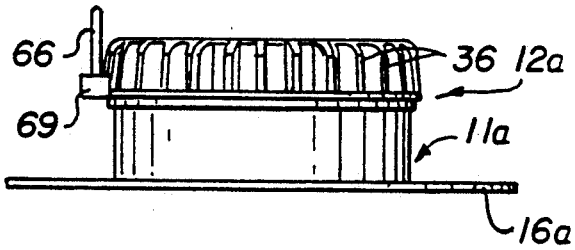
FIG. 9 is a side elevational view of a modified assembled cap and fitment.
Figure 10:
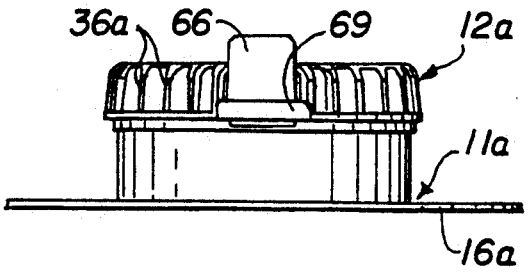
FIG. 10 is a view similar to FIG. 9 rotated 90°.
Figure 11:
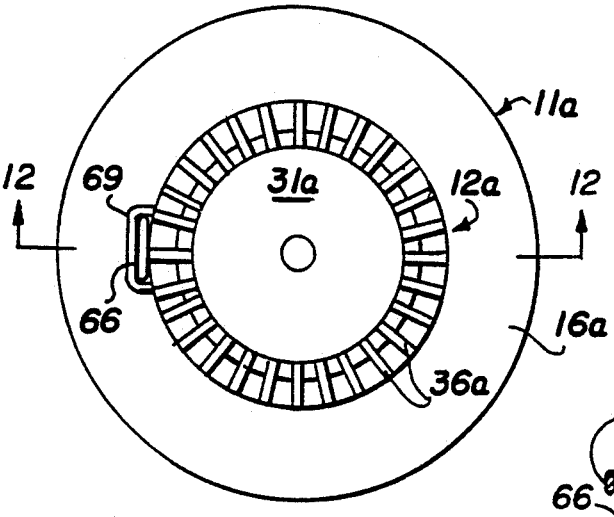
FIG. 11 is a top plan view of the structure of FIG. 9.

Directing attention to the structures shown in FIGS. 7 and 8, a foil disk 56 having a diameter greater than that of the flange 16 is initially secured to the underside of flange 16 in a circular pattern by means of a weld 57 or other means of attachment. Optionally, a circular weld 59 may be formed between the foil disk 56 and the bottom edge 52 of the plug skirt 32. The assembled fitment 11 and plug 12 are-installed in the container by inserting through the opening 14 in the panel 13. The outer portion of the flange 16 engages the underside of the panel 13 surrounding the opening 14. A weld 58 is formed between the foil 56 and the underside of the panel 13. It will be observed that an aseptic container may be provided since the opening 14 is completely sealed by the disk 61 which also seals the opening in the panel 13. Hence if the container and the contents are sterile when the container is filled and the container is sealed in sterile fashion, an aseptic package results.

In a preferred use of the device, the consumer either pulls upward on tab 44 or raises the tab 46, causing the band 41 to be disconnected from the cap 12 by fracturing the bridges 42. The cap 12 may then be unscrewed. Cap 12, of course, serves as a reclosure cap until the contents of the container are consumed.

In the modification shown in FIGS. 7 and 8 when the plug 12 is unscrewed, the weld between the bottom edge 52 of the skirt 32 causes fracture of the foil 56. The welding of the foil 56 to the bottom edge 52 is optional. Thus if the foil 56 is not removed from the area within the opening of the annular flange 16 when the plug 12 is removed, the presence of the foil is tamper evidence. The consumer may obtain access to the interior of the container by puncturing the foil 56 with a straw or a finger or an instrument such as a knife.

Figure 12:
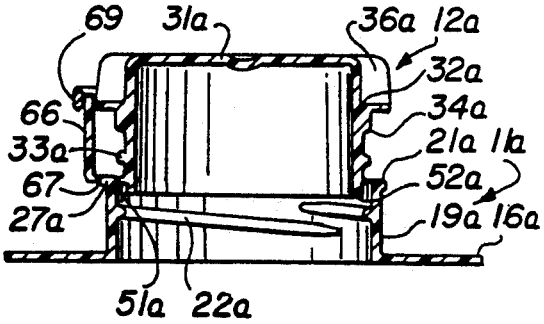
FIG. 12 is a sectional view taken substantially along the line 12—12 of FIG. 11 prior to assembly.
Figure 13:
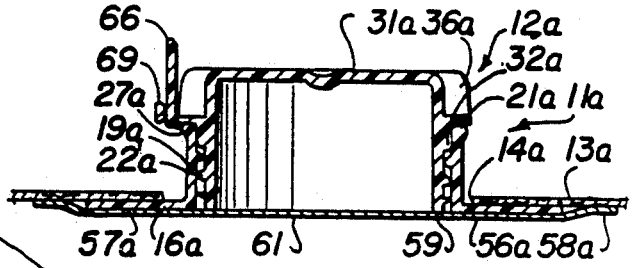
FIG. 13 is a vertical sectional view showing the plug assembled in the fitment and the fitment attached to a container panel.
Figure 14:
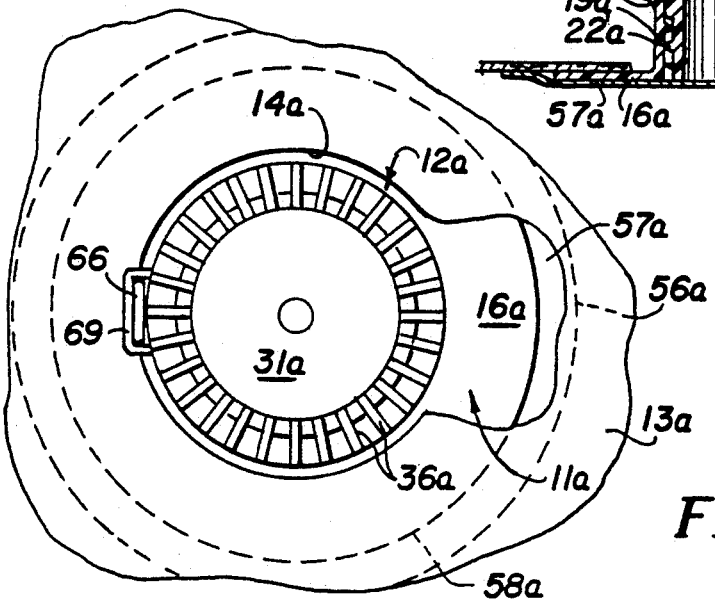
FIG. 14 is a plan view of the structure of FIG. 13.
Figure 15:
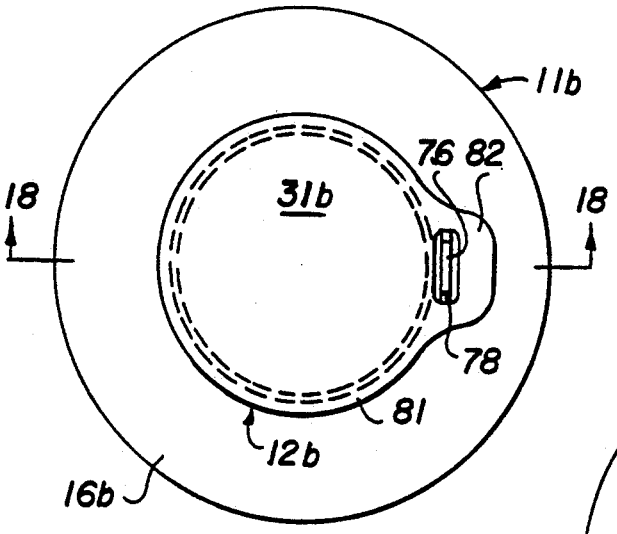
FIG. 15 is a top plan view of a further modified plug and fitment prior to assembly.
Figure 16:
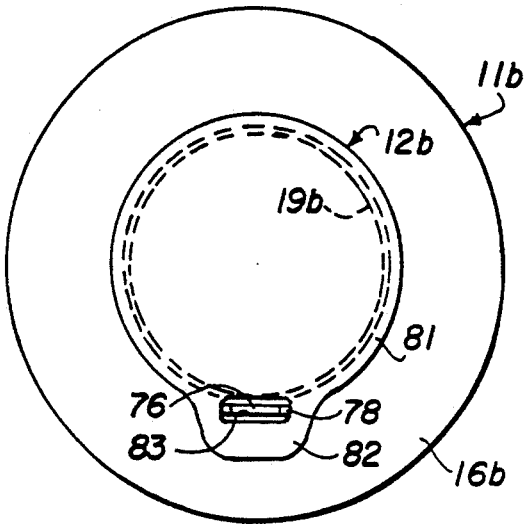
FIG. 16 is a view similar to FIG. 15 rotated 90°.
Figure 17:
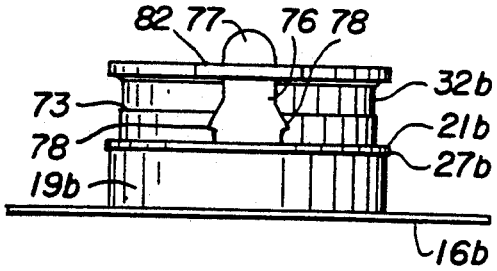
FIG. 17 is a side elevational view of the structure of FIG. 16.
Figure 18:
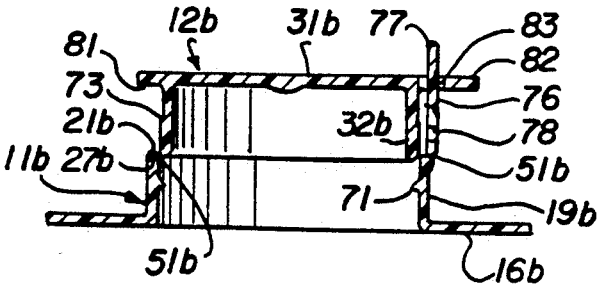
FIG. 18 is a vertical sectional view taken substantially along the line 18—18 of FIG. 15.

Directing attention now to the form of the invention shown in FIGS. 9–14, and first to FIG. 12, it will be seen that the plug **12*a* and fitment 11*a* may be initially molded together. One or more lugs 51*a* projecting outward from the edge 52*a* join the inner, upper edge of the rim 27*a* of the spout 19*a*. The lugs 51*a* are subsequently broken when the plug 12*a* is depressed into the fitment 11*a* and assumes the position shown in FIG. 13. Finger 66 extends vertically upward and is joined at its lower end by juncture 67 to the outer edge of rim 27*a*. The juncture 67 is a line of weakness. So long as this line 67 is unbroken, the combination is tamper evident. Loop 69 dimensioned to receive the finger 66 is formed extending out from the upper end of skirt 32*a*. When the plug 12*a* is inserted in the fitment 11*a*, the finger 66 extends up through the loop 69 and prevents unscrewing the plug 12*a*. The consumer may pull upward on the finger 66 to break the line of weakness 67 and then unscrew the plug 12*a* or the unscrewing of the plug 12*a* will cause the finger 66 to break off from the fitment. In either event, the assembly shown in FIG. 13** is tamper evident.

In many respects, the structure of FIGS. 9–14 resembles that of the preceding modification and the same reference numerals followed by the subscript "a"are used to indicate corresponding elements.

Figure 19:
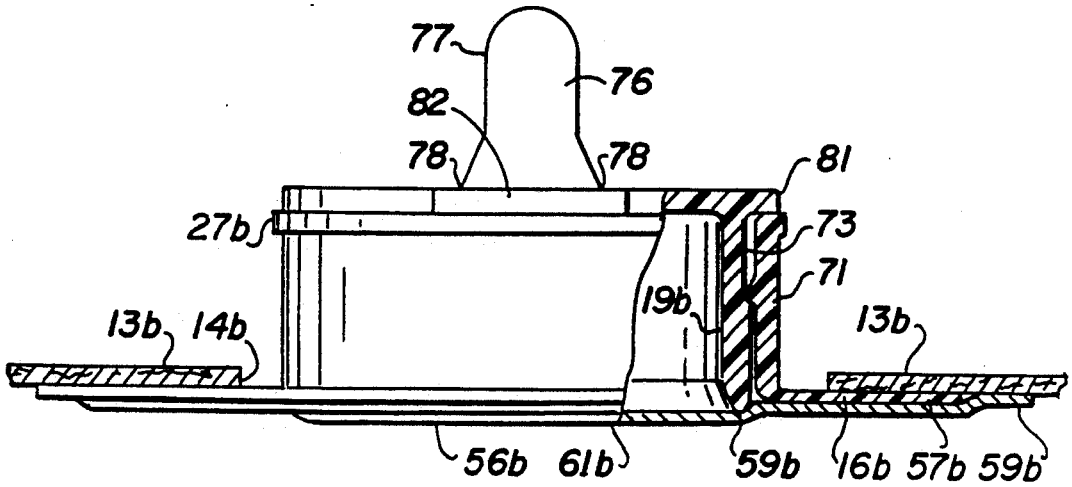
FIG. 19 is a side elevational view partially broken away in section showing the plug and fitment assembled and installed in a container panel.
Figure 20:
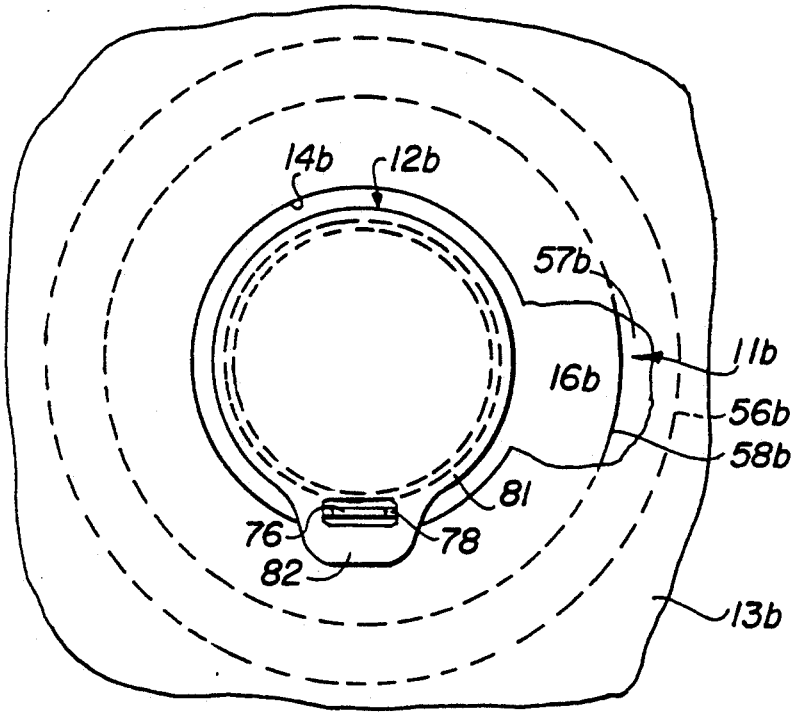
FIG. 20 is top plan view of the structure of FIG. 19.

Directing attention now to the form of the invention shown in FIGS. 15–20, it will be observed that the plug **12*b* fits inside the spout 19*b* with a liquid-tight fit but without the formation of threads. Seal bead 71 on the inside of spout 19*b* prevents leakage. When the plug is installed inside the spout 19*b* as shown in FIG. 19, the seal bead 71 engages over the shoulder 73 formed on the exterior of skirt 32*b*. This prevents the plug 12*b* from being unintentionally removed. Finger 76 of this modification is attached to the upper edge of spout 19*b* at a line of weakness 51*b*. Finger 76 has a rounded upper end 77 to facilitate insertion in slot 83 formed in ear 82 which projects out from the flange 81 of the top 31*b* of plug 12*b*. Outward projecting tangs 78 are formed on finger 76. When the parts are assembled the tangs 78 are above ear 82 (see FIG. 19), preventing removal of the plug without removing finger 76 and giving evidence of tampering. In other respects, the modification of FIGS. 15–20** resembles that of the preceding modifications and the same reference numerals followed by the subscript "b" are used to indicate the corresponding elements.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a fitment and a plug therefor said fitment being shaped to seal around an aperture in a panel of a container, said panel having inside and outside surfaces around said aperture, said fitment comprising an annular flange shaped to fit around said aperture having top and bottom surfaces, said top surface being dimensioned and shaped to be secured to said inside surface, a hole in said flange, a spout upstanding from said flange surrounding said hole, and first attachment means on said spout, said plug having a top, a skirt depending from said top, second attachment means on said skirt cooperable with said first attachment means to detachably secure said plug on said fitment, characterized by first tamper-evidencing means on said plug, second tamper-evidencing means on said fitment cooperable with said first tamper-evidencing means to prevent movement of said plug relative to said fitment so long as both said tamper-evidencing means are intact, and a seal member dimensioned larger than said flange secured to said bottom surface of said flange and dimensioned and shaped to be secured to said inside surface of said panel outside an outer edge of said flange, said seal member being unconnected to said panel except outside said flange.

2. The combination of claim 1 in which said first tamper-evidencing means comprises a ring around said plug, frangible means frangibly connecting said ring to said plug, and at least one narrow finger depending from said ring and said second tamper-evidencing means comprises at least one socket on said flange shaped and positioned to receive said at least one finger.

3. The combination of claim 2 in which said frangible means comprises thin bridges separated by spaces extending inward from said ring to said skirt.

4. The combination of claim 2 which further comprises a pull tab fixed to and extending upwardly from said ring, whereby pulling said tab breaks said frangible means.

5. The combination of claim 2 which further comprises a thumb tab extending substantially horizontally outward from said ring, whereby lifting said thumb tab breaks said frangible means.

6. The combination of claim 2 wherein said first and second attachment means comprise interfitting threads.

7. The combination of claim 1 in which said seal member is metallic foil.

8. The combination of claim 1 in which said seal member is attached to a lower edge of said skirt.

9. The combination of claim 1 and a container formed with an aperture, said seal member being attached in aseptic manner to said container.

10. In combination, a fitment and a plug therefor said fitment being shaped to seal around a aperture in a surface of a panel of a container, said fitment comprising an annular flange shaped to fit around said aperture, a hole in said flange, a spout upstanding from said flange surrounding said hole, and first attachment means on said spout, said plug having a top, a skirt depending from said top, second attachment means on said skirt cooperable with said first attachment means to detachably secure said plug on said fitment, characterized by first tamper-evidencing means on said plug, second tamper-evidencing means on said fitment cooperable with said first tamper-evidencing means to prevent movement of said plug relative to said fitment so long as both said tamper-evidencing means are intact, and a foil seal member dimensioned larger than said flange and dimensioned and shaped to be secured to said panel outside an outer edge of said flange, said first tamper-evidencing means comprising a ring around said plug, frangible means frangibly connecting said ring to said plug, a finger depending from said ring and said second tamper-evidencing means comprising a socket on said flange shaped and positioned to receive said finger, said finger being rectangular in cross-section, the width of said finger being positioned parallel to a horizontal tangent to said skirt.

11. The combination of claim 10 in which said socket comprises a vertical socket wall disposed outwardly relative to said finger.

12. The combination of claim 11 in which said socket wall is substantially parallel to a tangent to said spout.

13. In combination, a fitment and a plug therefor said fitment being shaped to seal around an aperture in a surface of a panel a of container, said fitment comprising an annular flange shaped to fit around said aperture, a hole in said flange, a spout upstanding from said flange surrounding said hole, and first attachment means on said spout, said plug having a top, a skirt depending from said top, second attachment means on said skirt cooperable with said first attachment means to detachably secure said plug on said fitment, characterized by first tamper-evidencing means on said plug, second tamper-evidencing means on said fitment cooperable with said first tamper-evidencing means to prevent movement of said plug relative to said fitment so long as both said tamper-evidencing means are intact, and a foil seal member dimensioned larger than said flange and dimensioned and shaped to be secured to said panel outside an outer edge of said flange, and frangible means initially frangibly interconnecting said plug and said fitment whereby said plug and said fitment may be injection molded in one piece.

14. In combination, a fitment and a plug therefor said fitment being shaped to seal around an aperture in a surface of a panel of a container, said fitment comprising an annular flange shaped to fit around said aperture, a hole in said flange, a spout upstanding from said flange surrounding said hole, and first attachment means on said spout, said plug having a top, a skirt depending from said top, second attachment means on said skirt cooperable with said first attachment means to detachably secure said plug on said fitment, characterized by first tamper-evidencing means on said plug, second tamper-evidencing means on said fitment cooperable with said first tamper-evidencing means to prevent movement of said plug relative to said fitment so long as both said tamper-evidencing means are intact, and a foil seal member dimensioned larger than said flange and dimensioned and shaped to be secured to said panel outside an outer edge of said flange, said first tamper-evidencing means comprising a ring around said plug, frangible means connecting said ring to said plug, a finger depending from said ring and said second tamper-evidencing means comprising a socket on said flange shaped and positioned to receive said finger, said finger being initially positioned immediately above said socket whereby axial movement of said plug toward said fitment without rotation seats said finger in said socket.

* * * * *